US010125945B2

(12) United States Patent
Yang et al.

(10) Patent No.: US 10,125,945 B2
(45) Date of Patent: Nov. 13, 2018

(54) LAMP APPARATUS FOR VEHICLE

(71) Applicant: Hyundai Motor Company, Seoul (KR)

(72) Inventors: Jeong Gyu Yang, Yongin-si (KR); Byoung Suk Ahn, Suwon-si (KR); Jin Ho Na, Suwon-si (KR); Jik Soo Shin, Incheon (KR)

(73) Assignee: Hyundai Motor Company, Seoul (KR)

( * ) Notice: Subject to any disclaimer, the term of this patent is extended or adjusted under 35 U.S.C. 154(b) by 354 days.

(21) Appl. No.: 14/937,485

(22) Filed: Nov. 10, 2015

(65) Prior Publication Data

US 2017/0059114 A1 Mar. 2, 2017

(30) Foreign Application Priority Data

Aug. 27, 2015 (KR) ..... 10-2015-0121170

(51) Int. Cl.

| | |
|---|---|
| ***F21S 8/00*** | (2006.01) |
| ***F21S 8/10*** | (2006.01) |
| ***F21S 43/14*** | (2018.01) |
| ***F21S 43/20*** | (2018.01) |
| ***F21S 43/31*** | (2018.01) |
| ***F21S 43/40*** | (2018.01) |
| *F21Y 115/10* | (2016.01) |

(52) U.S. Cl.

CPC ..... *F21S 48/234* (2013.01); *F21S 43/14* (2018.01); *F21S 43/26* (2018.01); *F21S 43/31* (2018.01); *F21S 43/40* (2018.01); *F21Y 2115/10* (2016.08)

(58) Field of Classification Search

CPC .... F21S 48/234; F21S 48/215; F21S 48/2212; F21S 48/24

See application file for complete search history.

(56) References Cited

U.S. PATENT DOCUMENTS

| | | | | |
|---|---|---|---|---|
| 4,517,630 A * | 5/1985 | Dieffenbach | ..... | F21S 41/255 362/509 |
| 7,688,347 B2 * | 3/2010 | Dolgoff | ..... | G03B 35/16 348/44 |
| 2005/0030759 A1 * | 2/2005 | Zollers | ..... | F21S 41/265 362/520 |
| 2006/0239006 A1 * | 10/2006 | Chaves | ..... | G02B 6/0018 362/294 |

FOREIGN PATENT DOCUMENTS

| | | | | |
|---|---|---|---|---|
| EP | 1182395 | * | 2/2002 | ..... F21S 8/10 |
| JP | 2007-123028 | A | 5/2007 | |
| JP | 2007-287521 | A | 11/2007 | |
| JP | 2010-80342 | A | 4/2010 | |
| KR | 10-2006-0119758 | A | 11/2006 | |
| KR | 10-0803310 | B1 | 2/2008 | |
| KR | 10-2013-0043936 | A | 5/2013 | |
| KR | 10-1470194 | B1 | 12/2014 | |
| KR | 10-2015-0061319 | A | 6/2015 | |

* cited by examiner

*Primary Examiner* — Anabel Ton
(74) *Attorney, Agent, or Firm* — Morgan, Lewis & Bockius LLP

(57) ABSTRACT

A vehicle lamp apparatus may include a reflector arranged on one curve of a hyperbola having two focal points, a light source, located at a focal point of the curve of the hyperbola on which the reflector is arranged, for irradiating the reflector with light corresponding to an image, and a condensing lens part on which light, emitted from the light source and reflected by the reflector, is incident, the condensing lens part including at least two lenses for condensing the light reflected by the reflector.

7 Claims, 3 Drawing Sheets

LAMP APPARATUS FOR VEHICLE

CROSS-REFERENCE TO RELATED APPLICATION

The present application claims the priority benefit of Korean Patent Application No. 10-2015-0121170, filed Aug. 27, 2015, the disclosure of which is incorporated herein by reference.

BACKGROUND OF THE INVENTION

Field of the Invention

The present invention relates to a vehicle lamp apparatus, and more particularly to a vehicle lamp apparatus that secures a sufficient quantity of light for a distance between an actual light source and a lens, has a package which is reduced in size, and provides a three-dimensional image.

Description of Related Art

In general, vehicle lamps include tail lamps, brake lamps which are turned on when a brake pedal is depressed, turn indicators, etc.

In recent years, the use of lamps that use LEDs (Light Emitting Diodes), which have a long service life and high luminous efficiency, as light sources, has increased. As illustrated in FIG. 1, a light source module 10A of a conventional lamp includes an LED light source 11, a PCB 12 for controlling the current supplied to the LED light source 11, a reflector 13 for reflecting the light emitted from the LED light source 11 toward an outer lens 21, and a light diffusion lens 14 which is installed in front of the reflector 13 to diffuse the light from the LED light source 11.

Due to the configuration of the light source module 10A in which the reflector 13 is installed in front of the LED light source 11, the overall size of the optical system including the LED light source 11 and the outer lens 21 is increased. For this reason, the degree of freedom in the design of the conventional lamp is low, and such a lamp is heavy and costly to manufacture.

In addition, the conventional light source module 10A has low visibility due to a method in which light emitted from the LED light source 11 is converted into a simple luminous image, such as a point, a line, or a surface, for radiation. In order to improve visibility, it is necessary to increase the number of LED light sources. However, there is a problem in that this significantly increases manufacturing costs.

In particular, lamps have recently been required to exhibit improved visibility and more aesthetic designs. However, since the above-mentioned conventional lamp has a large size due to the structure thereof, there is a problem in that the degree of freedom in the design of the lamp is low and in that the pattern of the light emitted from the lamp is not interesting.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a vehicle lamp apparatus that has a package which is reduced in size such that a degree of freedom in the design thereof is high, secures a sufficient quantity of light for a distance between an actual light source and a lens, and is capable of realizing a three-dimensional image.

In accordance with the present invention, the above and other objects can be accomplished by the provision of a vehicle lamp apparatus which includes a reflector arranged on one curve of a hyperbola having two focal points, a light source, located at a focal point of the curve of the hyperbola on which the reflector is arranged, for irradiating the reflector with light, and a condensing lens part on which light, emitted from the light source and reflected by the reflector, is incident, the condensing lens part including at least two lenses for condensing the light reflected by the reflector wherein the vehicle lamp apparatus may include a virtual light source and an actual light source.

The reflector may have the same shape as a shape formed by extension of the hyperbola.

In the two focal points of the hyperbola, a first focal point may be located on a central axis of the condensing lens part, and a second focal point may be located beneath a lowest end of the condensing lens part.

The light source may be located at the second focal point to be located beneath the lowest end of the condensing lens part, and the condensing lens part may have a shield formed at a lower portion thereof for blocking light such that the light is not directly radiated from the light source toward the condensing lens part.

The condensing lens part may include first and second Fresnel lenses which are arranged to face each other.

The virtual light source may be located at a first focal point of the two focal points of the hyperbola, the actual light source may be located at a second focal point, and the actual light source may be arranged such that light radiated toward the reflector includes light incident on the condensing lens part from the virtual light source.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
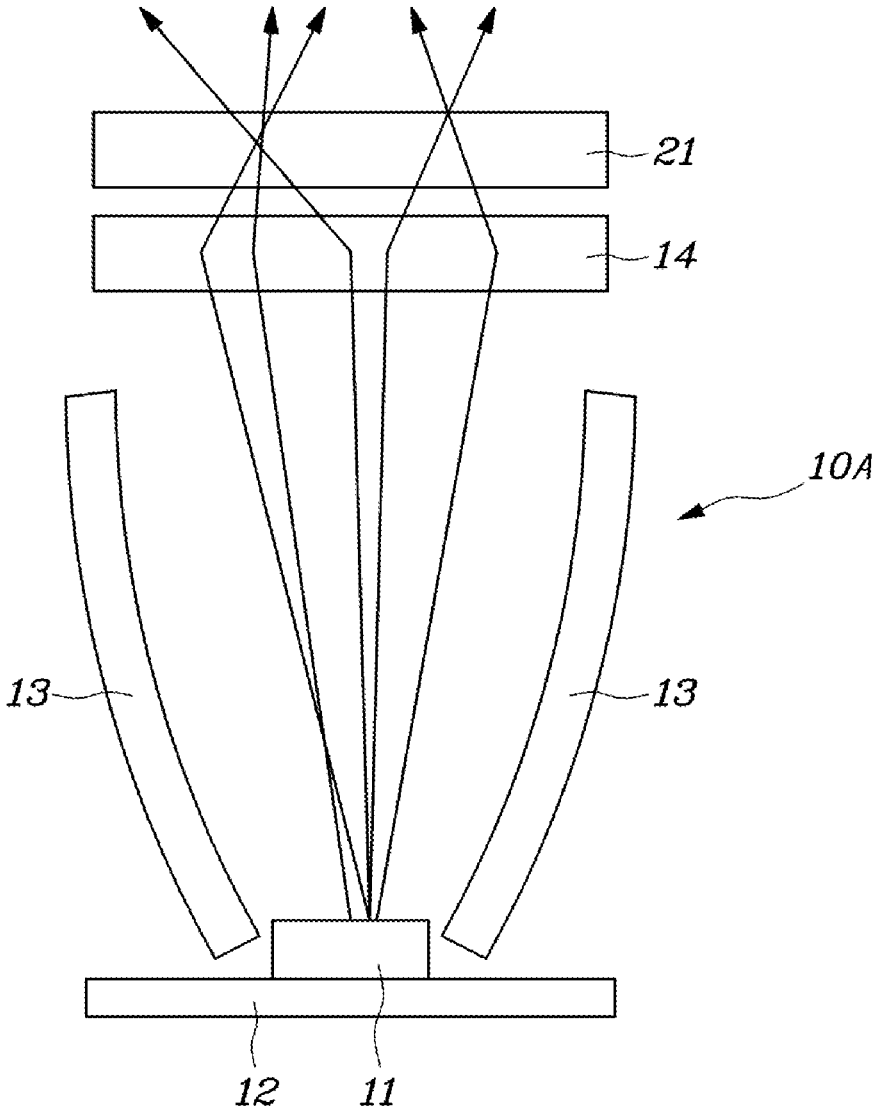
FIG. 1 Related Art
FIG. 1 is a view illustrating a conventional lamp module.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE EXEMPLARY EMBODIMENTS

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Reference will now be made in detail to the exemplary embodiments of the present invention, examples of which are illustrated in the accompanying drawings. Wherever possible, the same reference numbers will be used throughout the drawings to refer to the same or like parts.

Figure 2:
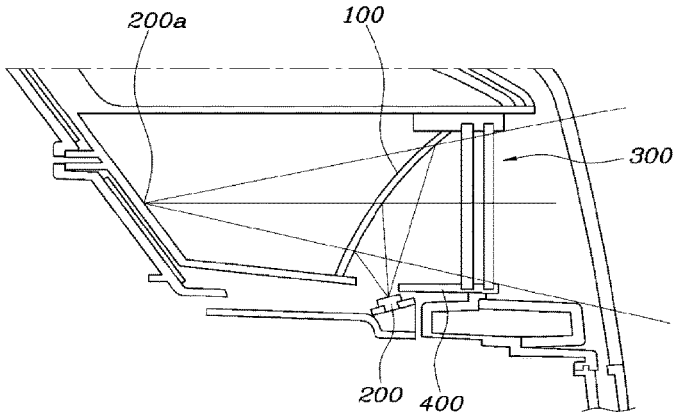
FIG. 2 is a view illustrating a vehicle lamp apparatus according to an embodiment of the present invention.
Figure 3:
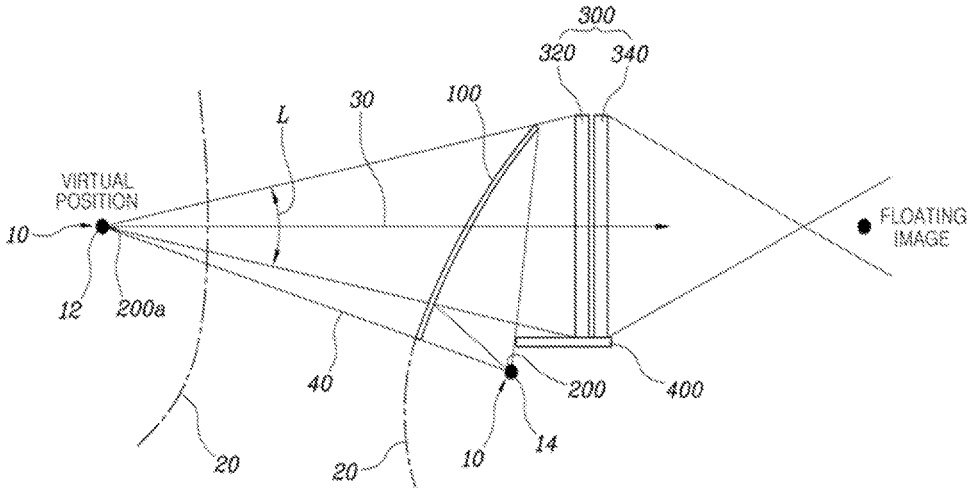
FIG. 3 and FIG. 4 are views for explaining the vehicle lamp apparatus of FIG. 2.
Figure 4:
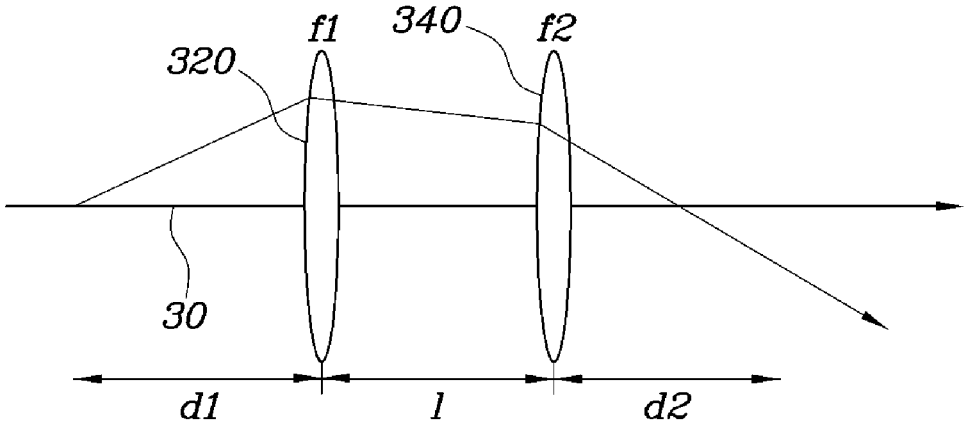

FIG. 2 is a view illustrating a vehicle lamp apparatus according to an exemplary embodiment of the present invention. FIGS. 3 and 4 are views for explaining the vehicle lamp apparatus of FIG. 2.

As illustrated in FIGS. 2 and 3, the vehicle lamp apparatus includes a reflector 100 arranged on one curve of a hyperbola 20 having two focal points 10, a light source 200 located at the focal point 10 of the curve of the hyperbola 20 on which the reflector 100 is arranged for irradiating the reflector 100 with light, and a condensing lens part 300 on which light emitted from the light source 200 and reflected by the reflector 100 is incident, the condensing lens part 300 including at least two lenses for condensing light reflected by the reflector.

The light source 200 has a shape intended to form three-dimensional images, and thus may form a specific lighting image by the application of a single light source or a surface light source corresponding to the intended image.

Aluminum is deposed on the inner surface of the reflector 100 on which light emitted from the light source 200 is incident such that a sufficient quantity of light may be reflected by the reflector 100. In particular, the reflector 100 is arranged on one curve of the hyperbola 20 formed about one of the two focal points 10, and may have the same shape as the shape formed by the extension of the curve of the hyperbola 20. Accordingly, when light emitted from the light source 200 is reflected by the reflector 100 and is radiated to the condensing lens part 300, a path of light may be defined as if light is radiated from the other focal point 10 as the reflector 100 is arranged on the hyperbola 20 and has the same shape as the hyperbola 20.

In addition, light from the light source 200 reflected by the reflector 100 is incident on the condensing lens part 300. Here, the condensing lens part 300 includes two Fresnel lenses, and thus forms a three-dimensional image that makes the image formed by the light passing through the condensing lens part 300 seem to protrude.

Therefore, since the positions of the light source 200 and the reflector 100 are determined using hyperbolic characteristics, it is possible to secure a sufficient quantity of light for the distance between the light source 200 and the condensing lens part 300. In addition, since the condensing lens part 300 includes two Fresnel lenses, it is possible to improve solid-angle efficiency and form a three-dimensional image at a specific position.

In detail, among the two focal points 10 of the hyperbola 20, a first focal point 12 may be located on a central axis 30 of the condensing lens part 300, and a second focal point 14 may be located beneath the lowest end of the condensing lens part 300, as illustrated in FIG. 3.

As such, the first and second focal points 12 and 14 of the hyperbola 20 are provided, a virtual light source 200*a* is located at the first focal point 12, and an actual light source 200 is located at the second focal point 14. Here, since the second focal point 14 is located beneath the lowest end of the condensing lens part 300, all of light emitted from the light source 200 located at the second focal point 14 is incident on the inner surface of the reflector 100, and is then reflected therefrom, thereby enabling a sufficient quantity of light to be secured.

Accordingly, the actual light source 200 is located at the second focal point 14, the first focal point 12 is located on the central axis 30 of the condensing lens part 300, and the second and first focal points 14 and 12 are selected as both focal points 10 of the hyperbola 20. Consequently, a main axis 40 of the hyperbola 20, which connects the first and second focal points 12 and 14, is located outside a path L of light which is incident onto the condensing lens part 300 from the virtual light source 200*a* located at the first focal point 12.

Meanwhile, the light source 200 is located at the second focal point 14, and is thus located beneath the lowest end of the condensing lens part 300. The lower portion of the condensing lens part 300 may be provided with a shield 400 which blocks light such that the light is not directly radiated from the light source 200 toward the condensing lens part 300.

As such, since the shield 400 is provided in the lower portion of the condensing lens part 300 such that light emitted from the light source 200 is not directly radiated toward the condensing lens part 300, light is prevented from being visible when the light of the light source 200 is directly radiated to the condensing lens part 300. The shield 400 may be set to have an appropriate length according to a region in which light emitted from the light source 200 is incident on the reflective surface thereof.

Meanwhile, the condensing lens part 300 may include first and second Fresnel lenses 320 and 340 which are arranged to face each other.

Since the condensing lens part 300 includes first and second Fresnel lenses 320 and 340, light passing through the first Fresnel lens 320 is again condensed through the second Fresnel lens 340, thereby enabling a three-dimensional image to be realized. In addition, it is preferable that the first and second Fresnel lenses 320 and 340 have the same specification in order to minimize distortion.

Meanwhile, the virtual light source 200*a* is located at the first focal point 12 of the two focal points 10 of the hyperbola 20, and the actual light source 200 is located at the second focal point 14. In this case, the actual light source 200 may be arranged such that light radiated toward the reflector 100 includes light which is incident on the condensing lens part 300 from the virtual light source 200*a*.

Thereby, light emitted from the actual light source 200 located at the second focal point 14 is reflected by the reflector 100 and is then radiated to the condensing lens part 300. In this case, since the reflector 100 has the same shape as the hyperbola 20, light reflected by the reflector 100 is realized as if it is emitted from the virtual light source 200*a* located at the first focal point 12. In addition, since light radiated toward the reflector 100 from the actual light source 200 located at the second focal point 14 includes light which is incident on the condensing lens part 300 from the virtual light source 200*a* located at the first focal point 12, the light emitted from the actual light source 200 may be radiated in a quantity similar to that of the light emitted from the virtual light source 200*a*.

In the vehicle lamp apparatus of the present invention, the first focal point 12 at which the virtual light source 200*a* is located, and the second focal point 14 at which the actual light source 200 is located, in the hyperbola 20, are set as follows. This will be described with reference to FIG. 4.

In the two first and second focal points 12 and 14 of the hyperbola 20, the position of the first focal point 12 at which the virtual light source 200*a* is located may be calculated using the following equation:

$$\frac{1}{d_1} + \frac{1}{d_2} = \frac{1}{F}$$

where F=the complex focal length of the first and second Fresnel lenses, $d_1$=the distance between the virtual light source and the first Fresnel lens, and $d_2$=the distance between the second Fresnel lens and the protruding three-dimensional image.

Here, the complex focal length of the first and second Fresnel lenses may be calculated using the following equation:

$$\frac{1}{F} = \frac{1}{f_1} + \frac{1}{f_2} = \frac{1}{f_1 f_2}$$

where F=the complex focal length of the first and second Fresnel lenses, $f_1$=the focal length of the first Fresnel lens, $f_2$=the focal length of the second Fresnel lens, and 1=the distance between the first and second Fresnel lenses.

As describes above, the complex focal length of the first and second Fresnel lenses 320 and 340 is first calculated using the above second equation. Here, the focal length of the first Fresnel lens 320 and the focal length of the second Fresnel lens 340 are determined in advance according to the specifications of the lenses, and the two lenses are configured to have the same specification so that the their focal lengths are the same as each other.

Through this configuration, when the complex focal length of the first and second Fresnel lenses 320 and 340 is determined, the position of the first focal point 12 at which the virtual light source 200*a* is located is calculated. Here, since the distance $d_2$ between the second Fresnel lens 340 and the protruding three-dimensional image is determined in advance according to some design, the distance $d_1$ between the virtual light source 200*a* and the first Fresnel lens 320 may be calculated by populating the above equations with the respective values.

As such, when the position of the first focal point 12 is determined, the second focal point 14 is set to be located beneath the lower portion of the condensing part 300, and the hyperbola 20 is formed based on the first and second focal points 12 and 14 such that light emitted from the actual light source located at the second focal point 14 is realized as if it is emitted from the virtual light source 200*a* located at the first focal point 12. Consequently, a three-dimensional image may be formed so as to protrude by an amount which is set in the condensing lens part 300.

In accordance with the present invention, the vehicle lamp apparatus having the above-mentioned structure can have a reduced package size such that the degree of freedom in the design thereof is high and can secure a sufficient quantity of light for the distance between the actual light source 200 and the lens.

In addition, it is possible to realize a three-dimensional image using light emitted from the lamp, and thus to improve the design of the vehicle lamp apparatus.

As is apparent from the above description, the vehicle lamp apparatus having the above-mentioned structure can have a reduced package size such that the degree of freedom in the design thereof is high and can secure a sufficient quantity of light for the distance between the actual light source and the lens.

In addition, it is possible to realize a three-dimensional image using light emitted from the lamp, and thus to improve the design of the vehicle lamp apparatus.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A vehicle lamp apparatus comprising:

a reflector arranged on one curve of a hyperbola having two focal points;

a light source, located at a focal point of the curve of the hyperbola on which the reflector is arranged, for irradiating the reflector with light corresponding to an image; and a condensing lens part on which light, emitted from the light source and reflected by the reflector, is incident, the condensing lens part comprising at least two lenses for condensing the light reflected by the reflector, wherein a virtual light source is located at a first focal point of the two focal points of the hyperbola, an actual light source is located at a second focal point, and the actual light source is arranged such that light radiated toward the reflector comprises light incident on the condensing lens part from the virtual light source.

2. The vehicle lamp apparatus according to claim 1, wherein the reflector has a same shape as a shape formed by extension of the hyperbola.

3. The vehicle lamp apparatus according to claim 1, wherein, in the two focal points of the hyperbola, the first focal point is located on a central axis of the condensing lens part, and the second focal point is located beneath a lowest end of the condensing lens part.

4. The vehicle lamp apparatus according to claim 3, wherein the light source is located at the second focal point to be located beneath the lowest end of the condensing lens part, and the condensing lens part has a shield formed at a lower portion thereof for blocking light such that the light is not directly radiated from the light source toward the condensing lens part.

5. The vehicle lamp apparatus according to claim 1, wherein the condensing lens part comprises first and second Fresnel lenses which are arranged to face each other.

6. The vehicle lamp apparatus according to claim 5, wherein, in the two focal points of the hyperbola, a position of the first focal point, at which the virtual light source is located, is determined using a following equation:

$$\frac{1}{d_1} + \frac{1}{d_2} = \frac{1}{F}$$

where F=a complex focal length of the first and second Fresnel lenses, $d_1$=a distance between the virtual light source and the first Fresnel lens, and $d_2$=a distance between the second Fresnel lens and a protruding three-dimensional image.

7. The vehicle lamp apparatus according to claim 6, wherein the complex focal length of the first and second Fresnel lenses is determined using a following equation:

$$\frac{1}{F} = \frac{1}{f_1} + \frac{1}{f_2} = \frac{1}{f_1 f_2}$$

where F=the complex focal length of the first and second Fresnel lenses, $f_1$=a focal length of the first Fresnel lens, $f_2$=a focal length of the second Fresnel lens, and 1=a distance between the first and second Fresnel lenses.

* * * * *